United States Patent [19]

Shibata

[11] Patent Number: 5,072,809

[45] Date of Patent: Dec. 17, 1991

[54] LUBRICATING DEVICE FOR FOUR STROKE OUTBOARD MOTOR

[75] Inventor: Yasuhiko Shibata, Hamamatsu, Japan

[73] Assignee: Sanshin Kogyo Kabushiki Kaisha, Hamamatsu, Japan

[21] Appl. No.: 512,782

[22] Filed: Apr. 20, 1990

[30] Foreign Application Priority Data

Apr. 20, 1989 [JP] Japan ..... 1-98797

[51] Int. Cl.[5] ..... F01M 11/06

[52] U.S. Cl. ..... 184/6.13; 184/6.2; 123/196 R

[58] Field of Search ..... 184/6.2, 6.4, 6.13, 184/6.18, 108; 123/196 S, 196 R

[56] References Cited

U.S. PATENT DOCUMENTS 2,991,845 7/1961 Scheffler, Jr. ..... 184/6.13

4,709,671 12/1987 Sumigawa ..... 123/196 S

FOREIGN PATENT DOCUMENTS 0016217 1/1986 Japan ..... 184/6.28

0229913 10/1986 Japan ..... 184/6.28

*Primary Examiner*—James C. Yeung

*Assistant Examiner*—Alan B. Cariaso

*Attorney, Agent, or Firm*—Ernest A. Beutler

[57] ABSTRACT

A number of embodiments of outboard motors including dry sump lubricated four cycle internal combustion engines. The dry sump lubrication system includes a scavenge pump for drawing lubricant drained from the engine lubricating system through an inlet port and returns it to a dry sump reservoir through an outlet port and a pressure pump that draws lubricant from the dry sump lubricant reservoir through an inlet port and delivers it the engine lubricating system through an outlet port. At least one of the ports of each of the pumps is positioned above the normal lubricant level in the lubricant reservoir when it is filled with the normal volume of lubricant so as to insure that lubricant will not drain back into the engine when the pump system is not operating. Various arrangements for achieving this result and for cooling the lubricant are described.

21 Claims, 16 Drawing Sheets

LUBRICATING DEVICE FOR FOUR STROKE OUTBOARD MOTOR

BACKGROUND OF THE INVENTION

This invention relates to a lubricating device for a four stroke outboard motor and more particularly to a dry sump lubrication system for an outboard motor.

Although two cycle engines are normally utilized in the power plant in an outboard motor, there are some advantages to the use of four cycle engines for this purpose. However, one disadvantage with the four cycle engine is that the compact nature of an outboard motor makes it difficult to provide an adequate closed lubricating system for the engine. Specifically, it is necessary to provide an oil reservoir that will have a sufficient volume to accommodate long running periods and which will maintain a relatively low oil temperature. For a variety of reasons, not the least of which is the fact that the outboard motors generally have their engines operating with their crankshafts rotating about a vertically extending axis, the use of dry sump lubrication systems for outboard motor applications are very advantageous. A dry sump lubrication system permits the lubricant reservoir to have a large volume, and also to be placed at a convenient location.

One of the problems in connection with the design of a lubrication system for an outboard motor is the fact that such motors are normally mounted on the transom of an associated watercraft for trim adjustment through a plurality of trim positions and also for tilting up out of the water during storage. Of course, the lubrication system must be capable of operating efficiently in all of the trim positions and also must be capable of accommodating the tilting up out of the water movement. This particular condition can be a problem because the abnormal orientation of the engine can give rise to the condition that lubricant will flow back from the reservoir into the engine.

In addition to this problem, when the outboard motor is tilted back down to its normal running condition, it must be insured that there will be adequate lubrication for the engine if it is started immediately. That is, if the oil or lubricant drains to a different part of the system, the oil must be returned to the area where the pump is to insure that the engine is adequately lubricated upon restarting.

Aside from the aforenoted problems, there is the additional concern that lubricant can flow from the dry sump tank back into the engine during periods of time when the engine is not running. This is a particular problem either when the orientation is changed, as aforenoted, or if the engine is shut off under conditions when a portion of the lubricant level lies above a lower portion of the engine.

Compounding the aforenoted problems is the fact that frequently outboard motors are detached from the transom of the watercraft and are laid on their side, front or back. Obviously, all of the aforenoted problems can be particularly acute when this condition prevails. The lubrication systems proposed for engines previously simply have not been capable of accommodating all of these conditions and solving all of the noted problems.

It is, therefore, a principal object of this invention to provide an improved lubricating system for an outboard motor.

It is a further object of this invention to provide a dry sump lubricating system for an outboard motor that insures that lubricant cannot flow into the engine when the engine is not running or in the event the orientation of the engine is changed.

It is also an object of this invention to provide a dry sump lubrication system for an outboard motor that will insure that the outboard motor is adequately lubricated if it has been displaced from its normal position when it was not running then is returned to a normal position and started.

SUMMARY OF THE INVENTION

This invention is adapted to be adapted in an outboard motor that is adapted to be mounted on the transom of a watercraft for tilt and trim movement between a plurality of trim adjusted running positions and a tilted up out of the water position. An internal combustion engine is provided in the power head of the outboard motor for driving a propulsion device of the outboard motor. A dry sump tank is provided for containing lubrication for the engine. A scavenge pump is driven by the engine and has an inlet port for receiving lubricant drained from the lubrication of the engine and an outlet port for returning lubricant from the engine to the dry sump tank. A pressure pump is driven by the engine and has an inlet port in the dry sump tank for drawing lubricant therefrom and an outlet for delivering lubricant under pressure to the engine for its lubrication. In accordance with the invention, at least one port of each of the pumps is positioned above the level of lubricant in the dry sump tank when the dry sump tank is filled with its normal volume of lubricant regardless of the position of the outboard motor on the transom to insure against leakage of lubricant from the dry sump tank into the engine when the engine is not running.

DETAILED DESCRIPTION OF THE PREFERRED EMBODIMENTS OF THE INVENTION

Figure 1:
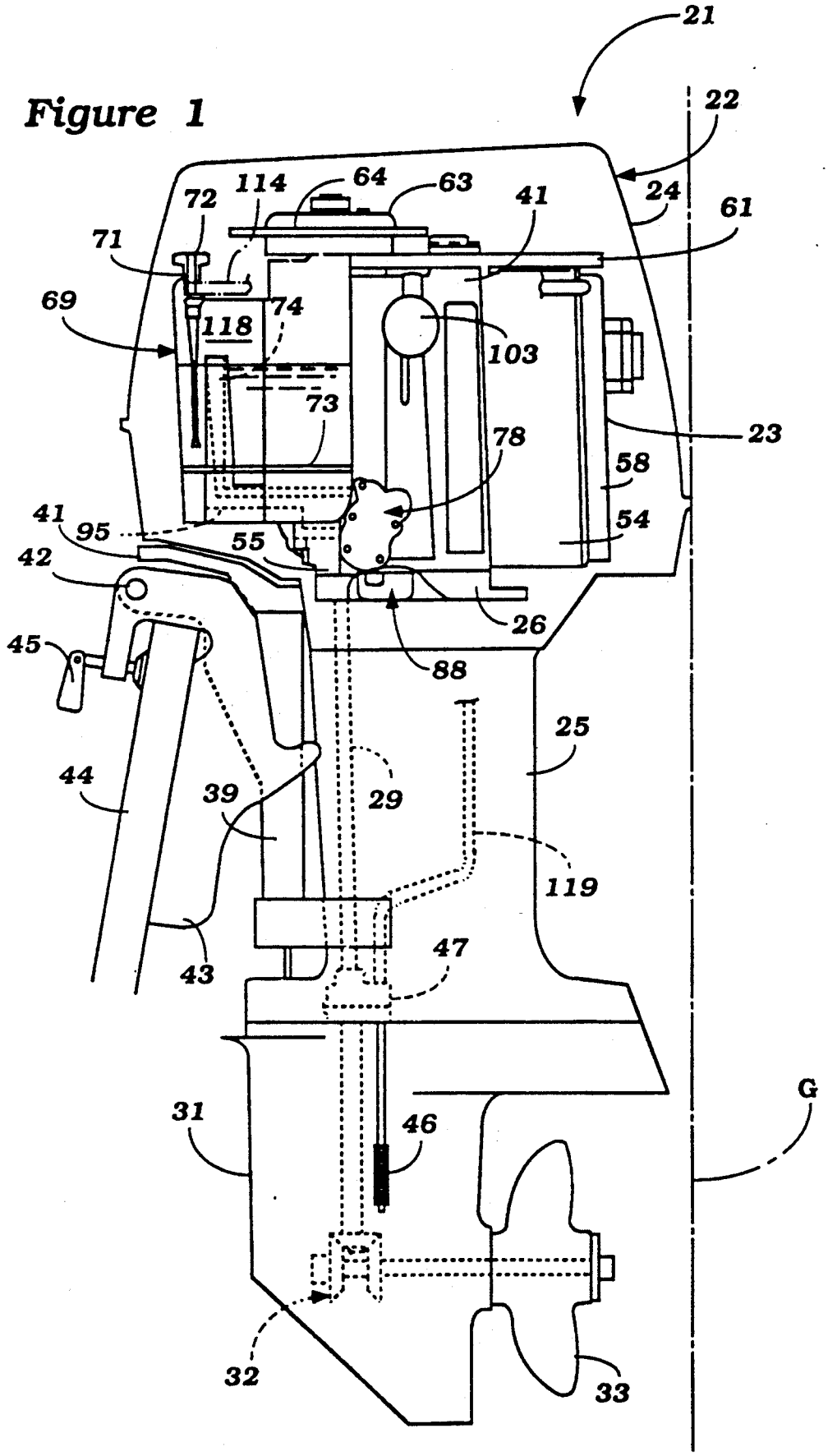
FIG. 1 is a side elevational view of an outboard motor constructed in accordance with an embodiment of this invention, with portions broken away and other portions are shown in section.
Figure 2:
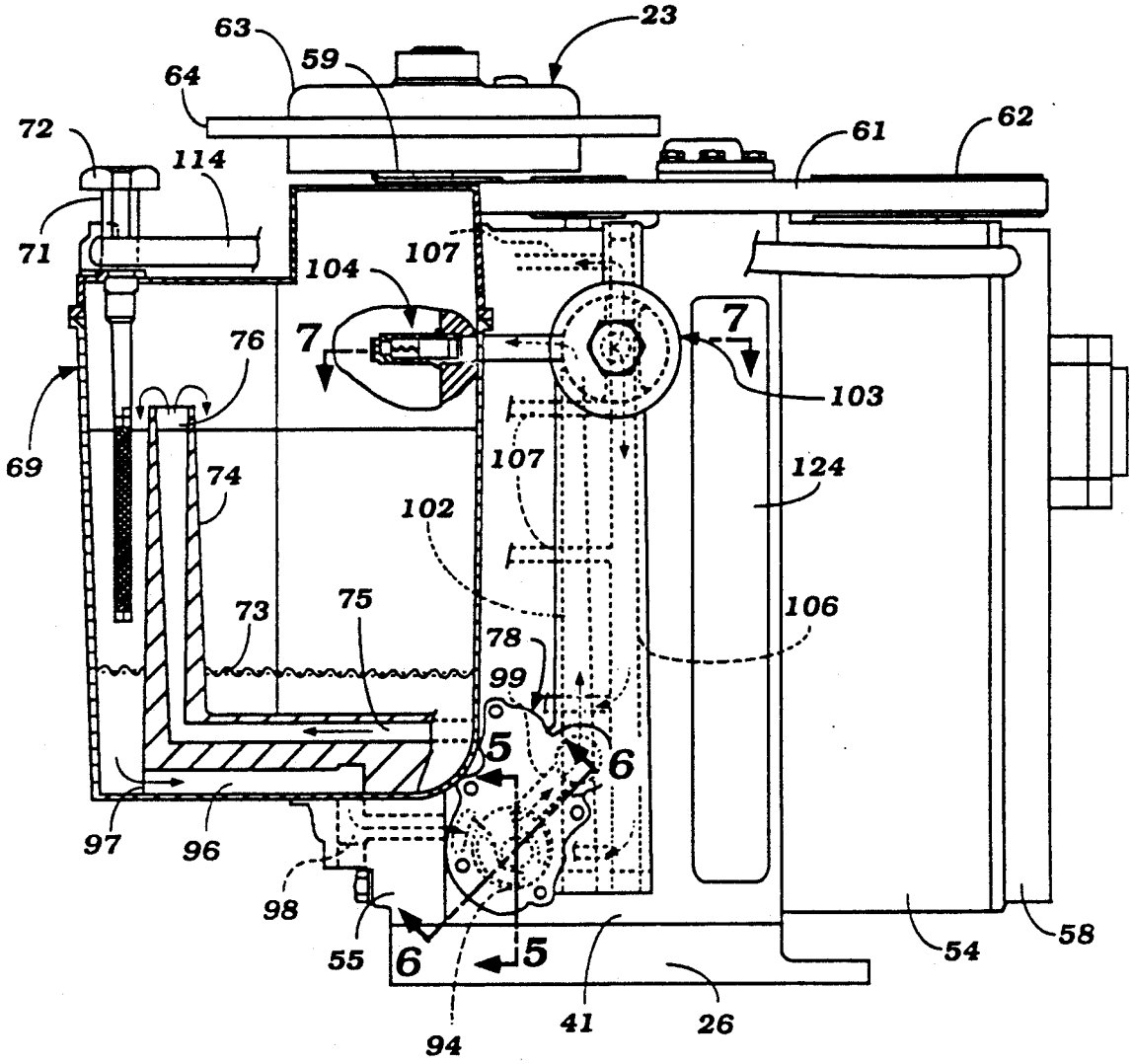
FIG. 2 is an enlarged side elevational view of the internal combustion engine and lubricant tank of the outboard motor with portions broken away and shown in section.

Referring first to the embodiment of FIGS. 1 through 9 and initially primarily to FIG. 1, an outboard motor constructed in accordance with this embodiment is identified generally by the reference numeral 21. The outboard motor 21 includes a power head, indicated generally by the reference numeral 22 and which consists primarily of an internal combustion engine 23 which, in the illustrated embodiment, is of the four cylinder in line type and operates on a four stroke cycle, and a surrounding protective cowling 24 which may be of any suitable type. The engine 23, as has been noted, is of the four cylinder in line type, but it is to be understood that the invention can be utilized in conjunction with engines having other numbers of cylinders and other cylinder configurations or, for that matter, with rotary engines.

A drive shaft housing 25 depends from the power head 22 and is affixed to the engine 23 by means of a spacer plate assembly 26. A drive shaft 29 is coupled to the engine output shaft and is journaled within the drive shaft housing 25. This drive shaft 29 depends into a lower unit 31 that is connected to the drive shaft housing 25 in a suitable manner and which contains a forward, neutral, reverse transmission 32 driven by the drive shaft 29 for selectively driving a propeller 33 in forward or reverse directions.

A steering shaft (not shown) is affixed to the drive shaft housing 25 by suitable means. The steering shaft is journaled for steering movement within a swivel bracket assembly 39. A tiller 41 is affixed in a suitable manner to the upper end of the steering shaft so as to steer the outboard motor 21, in a manner well known in this art.

The swivel bracket 39 is pivotally connected by means of a pivot pin 42 to a clamping bracket 43. This pivotal connection permits tilt and trim movement of the outboard motor 21 relative to a transom 44 of an associated watercraft to which it is fixed by means of a clamping assembly 45 carried by the clamping bracket 43.

The engine 23 is water cooled. The cooling system includes a water inlet 46 that is disposed in the lower unit 31 at a location where it will be submerged during normal phases of engine operation. A water pump 47 is driven by the drive shaft 29 and is contained at the junction between the drive shaft housing 25 and the lower unit 31. Water is circulated through the engine cooling jacket by the water pump 47 in a known manner and this water is returned to the body of water in which the watercraft is operating by a return.

Referring now additionally primarily to FIGS. 2 through 7, the engine 23 includes a cylinder block 48 in which four horizontally disposed cylinder bores 49 are formed. As is conventional with outboard motor practice, the cylinder bores 49 are disposed in a horizontal plane so that the pistons 51 which reciprocate in them will drive the associated crankshaft 52 for rotation about a vertically extending axis through their connection therewith by connecting rods 53 The crankshaft 52 is connected to the drive shaft 29 in a suitable manner as by means of a coupling (not shown). The crankshaft 52 is journaled for rotation by suitable bearings and is contained within a crankcase chamber 54 that is formed by the lower portion of the cylinder block 48 and a crankcase 55 that is affixed to the cylinder block 48 in a known manner.

A cylinder head 56 is affixed to the cylinder block 48 in a known manner and contains a plurality of intake and exhaust valves (not shown) that control the flow of intake charge into the cylinders 49 and exhaust charge therefrom. These valves are operated by one or more overhead camshafts 57 that are journaled in a camshaft chamber 60 of the cylinder head assembly 56 in a known manner. A cam cover 58 encloses the camshaft chamber 60 of the engine.

It should be noted that a sprocket 59 is affixed to the crankshaft 52 immediately above the cylinder block 48 and drives a belt 61 which, in turn, drives a toothed sprocket 62 that is affixed to the camshaft 57 for driving it at one half of crankshaft speed, as is well known in this art.

A flywheel magneto assembly 63 is affixed to the upper end of the crankshaft 52 above the sprocket 59 and provides the electrical power for firing the spark plugs of the engine in a known manner. Basically, the internal components of the engine, except for the lubricating system, form no part of the invention. For that reason, the basic construction of the engine has not been illustrated in any more detail than is necessary so as to permit those skilled in the art to understand the invention and the way it is practiced.

The flywheel magneto assembly 63 may have affixed to it a starter gear 64 that can be driven by an electrical starting motor 65 for ease of starting of the engine 23.

The engine 23 further includes an induction system (FIG. 9) including an intake manifold 66 that receives a fuel/air charge from one or more carburetors 67 for delivery to the engine combustion chambers through the intake valves in a known manner. The carburetors 67 have air horns 68 that draw air from within the protective cowling 24 which may enter through an external air inlet formed in the top portion of the cowling 24 in a known manner.

The exhaust gases from the engine 23 are discharged through an exhaust system which may be of any known type, for example, that of the type disclosed in copending application entitled "Lubricating Device For Four Stroke Outboard Motor", Ser. No. 501,272, filed 03/29/90 and now U.S. Pat. No. 5,037,340. Since the exhaust system per se forms no part of the invention in this application, further description of it is unnecessary and the disclosure of my aforenoted copending application is incorporated herein by reference. As noted in that application, a portion of the cooling water which has circulated through the engine 23 may be employed for cooling the exhaust gases.

The lubrication system for the engine 23 includes an external dry sump oil reservoir 69 which, in this embodiment, is mounted externally of the engine 23 but within the power head 22. By externally of the engine, it is meant that the lubricant reservoir 69 is not formed by any of the main castings or components of the engine nor is the reservoir formed internally of the engine. Because of the use of this external reservoir, it is possible to maintain an adequate volume of lubricant for the engine 23 even though it runs at high speeds for long periods of time without encroaching in the drive shaft housing 25.

Figure 9:
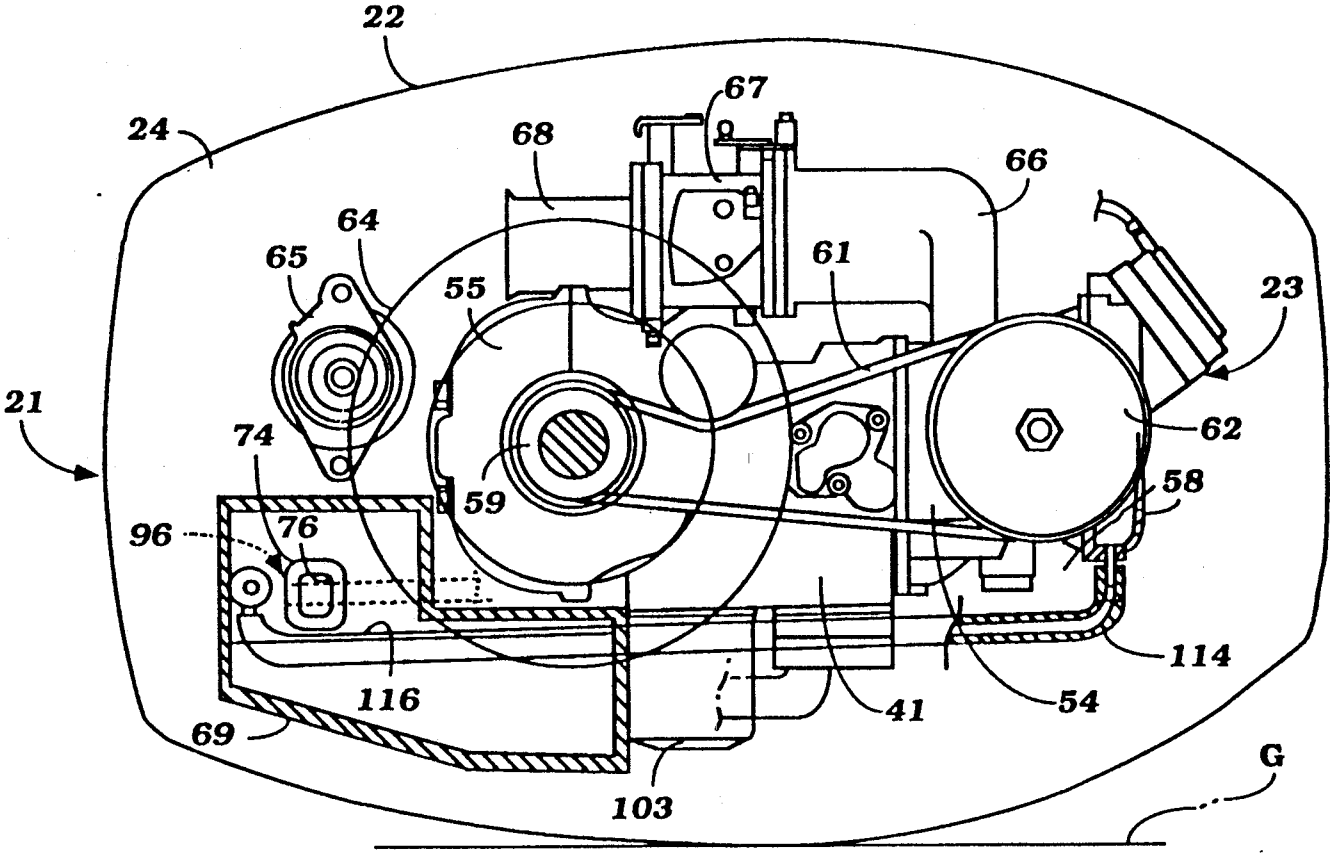
FIG. 9 is a top plan view, with a portion of the cowling removed, showing the outboard motor lying on its side.

The reservoir 69 may be conveniently formed from a lightweight metal such as sheet metal or an aluminum alloy and is, in this illustrated embodiment, disposed adjacent the crankcase 55 of the engine and has a generally L shaped configuration in top plan view as shown in FIG. 9. Of course, other configurations can readily be employed and, as will be noted hereinafter, other locations are also possible. Lubricant may be added to the oil reservoir 69 through a suitable fill opening, for example an opening 71 that is closed by a combined closure and dipstick 72. There may also be provided a drain passage (not shown) in the lower portion of the oil reservoir 69 so that it may be drained for servicing. Adjacent the lower end of the reservoir 69 there is provided a transversely extending screen 73 which serves to prevent foreign particles of large size and any entrained air from passing through the lubricating system back to the engine.

A stand pipe 74 is formed in the lower portion of the oil reservoir 69 and has a passageway 75 having an inlet port 76 that communicates the oil reservoir 69 with the return outlet of a scavenge pump 77 (FIG. 5 and 6) which forms a part of a pump assembly 78. A light check valve 79 is provided between the outlet of the scavenge pump 77 and the passageway 75 so as to prevent any reverse flow. Because the stand pipe 74 extends above the normal oil level in the reservoir 69, return oil will be discharged back down into the reservoir along the sides of the stand pipe 74 so as to assist in air separation from the return lubricant and also to insure minimizing of frothing and the inclusion of air in the oil reservoir 69.

Figure 4:
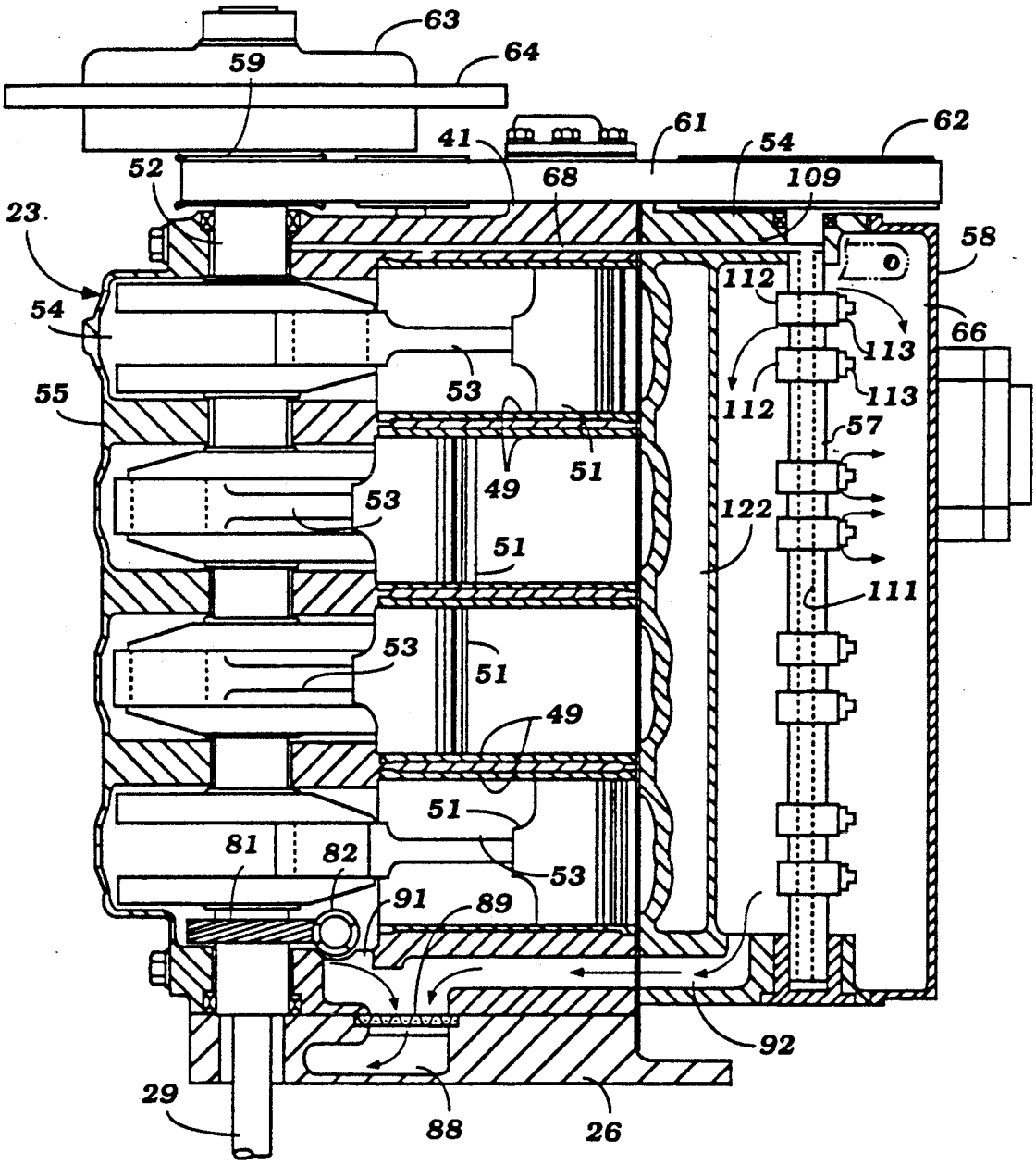
FIG. 4 is a cross sectional view taken through the engine on a plane parallel to the plane of FIG. 2.
Figure 5:
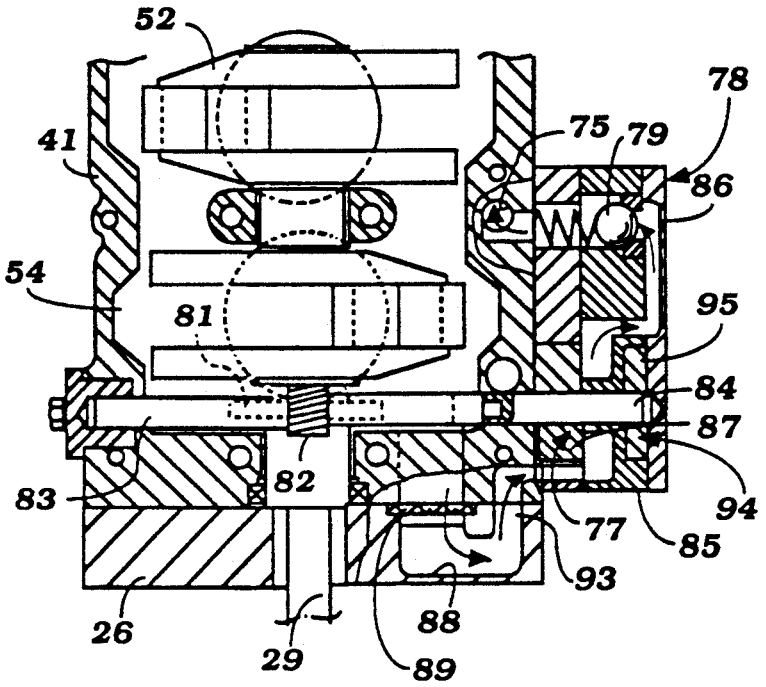
FIG. 5 is a cross sectional view taken along the line 5—5 of FIG. 2.
Figure 6:
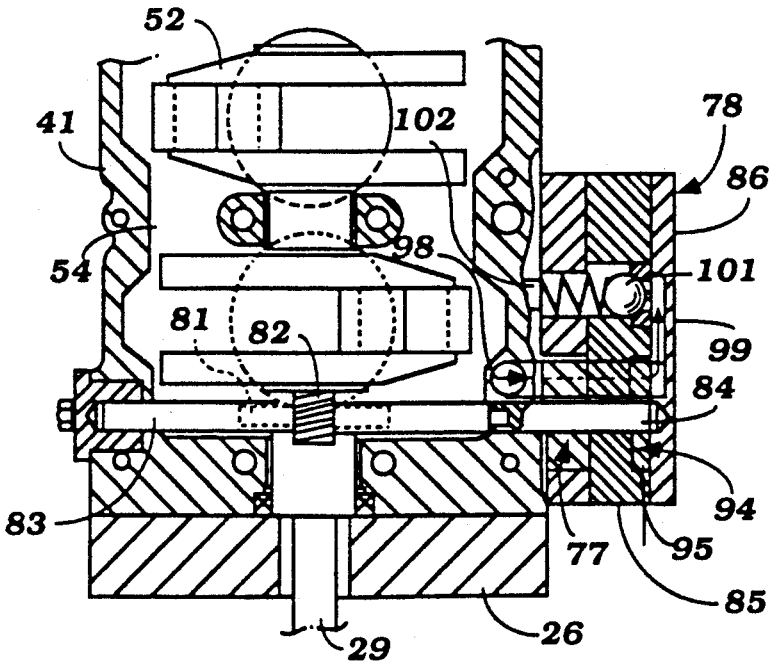
FIG. 6 is a cross sectional view taken along the line 6—6 of FIG. 5.
Figure 7:
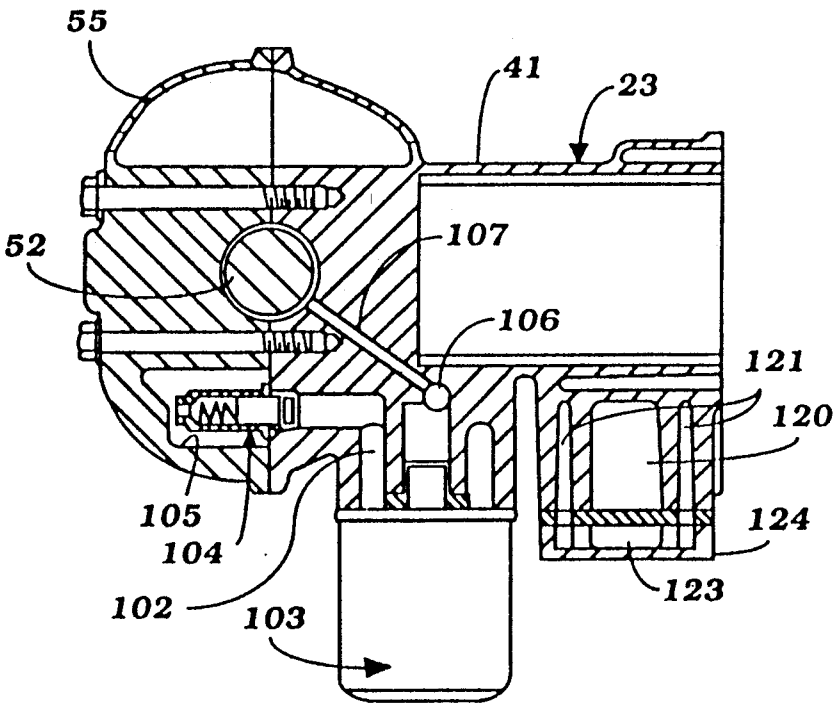
FIG. 7 is a cross sectional view taken along the line 7—7 of FIG. 2.

As may best be seen in FIGS. 4, 5 and 6, the pump assembly 78 is driven off of the lower end of the crankshaft 52 by means of a worm gear 81 that is affixed to or formed integrally with the crankshaft 52 and which engages a worm wheel 82 which is, in turn, affixed to or integrally connected to a pump drive shaft 83 that is journaled in the crankcase 55 and cylinder block 41. This shaft has a splined connection to a further shaft 84 of the pump assembly 78 that is journaled in its outer housing 85 and cover plate 86. The scavenge pump 77 is of the tricodal type and includes a rotor 87 and draws lubricant which has been drained from the engine into a well 88 formed by the spacer plate 26. A filter screen 89 is positioned between the spacer plate 26 and the cylinder block 41 for removing large particles from the drained oil.

The lubricant drains into the well 88 from the crankcase chamber 54 after lubricating the crankshaft bearings in a manner to be described through a return passageway 91. In addition, lubricant that has lubricated the camshaft 57 and which has accumulated at the base of the cam chamber 60 will flow back to the well 88 through a passageway 92 formed in both the cylinder head 54 and cylinder block 41. This drained lubricant is then delivered to the scavenge pump 77 through an inlet port 93 that is formed in the spacer plate 26 and cylinder block 41. The oil is then returned to the lubricant tank 69 through the path previously described.

Figure 3:
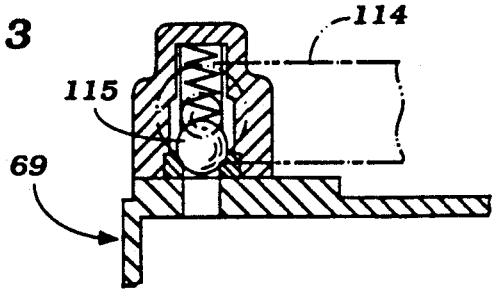
FIG. 3 is a further enlarged cross sectional view showing the crankcase ventilation system and its association with the dry sump tank.

The pump assembly 78 further includes a pressure pump 94 which is also of the tricodal type and which includes a rotor 95. As previously noted, the pump 94 is also driven from the shaft 84. Lubricant is delivered to the pressure pump 94 through a conduit 96 (FIG. 2) that has an inlet port 97 communicating with the reservoir 69 below the screen 73 that is formed in the lower portion of the stand pipe 74 and a passageway 98 formed in the cylinder block 48 (FIGS. 3 and 5). This lubricant then is delivered through a passageway 99 formed in the cover plate 86 of the pump assembly 78 to a light check valve 101. The check valve 101 discharges into a vertically extending passageway 102 formed in the cylinder block and which communicates with the inlet side of an oil filter 103 (FIG. 2) that is mounted appropriately on the side of the cylinder block assembly at the upper end thereof for ease of servicing and for a reason to be described. The check valve 101 is to prevent lubricant flow into the engine 23 from the reservoir 69 when the engine is not running.

A pressure relief valve 104 (FIGS. 2 and 7) also communicates with the pump outlet through the conduit 102 and maintains a maximum pressure in the pressure side of the oil delivery system. This pressure is relieved through a port 105 which drains back into the engine return system and eventually communicates with the well 88.

The outlet side of the oil filter 104 communicates with a vertically extending main oil gallery 106 (FIGS. 2 and 7) which, in turn, delivers lubricant to a plurality of cylinder block passageways 107 that deliver lubricant in a known manner to the main bearings of the crankshaft. In addition, the main oil gallery 106 or any of the crankshaft passages 107 communicates with a cross drilled passageway 108 (FIG. 4) which, in turn, communicates with a further passageway 109 formed in the cylinder head for delivering lubricant to a passageway 111 in the camshaft 57 for its lubrication. The lubricant may flow through the main bearings of the camshaft and also the cam lobes 112 for lubricating them and the valve operator rocker arms 113 and is returned through the drain passageway 92 that also delivers the return oil to the well 88.

The engine lubricating system thus far described is provided with a vent pipe 114 (FIGS. 1, 2 and 3) that interconnects the upper end of the camshaft chamber 60 and crankshaft chambers with the upper portion of the oil reservoir 69 through a check valve 115 (FIG. 3) for minimizing pressure differences. It should be noted that the vent passage 114 is not only above the normal oil level in the system when the outboard motor 21 is in its upright position, but is also above the oil level line 116 even when filled with its normal maximum volume as shown in FIG. 9 when the outboard motor 21 is laid on its side. This will prevent lubricant from flowing back from the reservoir into the lubricant system. The check valves 79, 101 and 115 also serve this purpose.

Although the check valves 79, 101 and 115 serve the purpose of precluding leakage of the oil from the various components back into the engine 23 during such times as the engine 23 is not running, the fact that the outboard motor 21 may be tilted up or may be stored laying on either its sides, front or back, means that there is a possibility that, with conventional dry sump systems, lubricant can drain back into the engine which can cause problems on restarting. However, the inlet and outlet ports and configuration of the passageways associated with the pump assembly 7 is such that such flow is also precluded.

It should be noted that when the engine is operating in its normal position and its trim adjusting positions, the return port 76 of the scavenge pump assembly 77 is above the normal oil level in the reservoir 69 when the reservoir 69 is filled with its maximum normal volume of oil. In a like manner, the outlet port of the pressure pump 94 which is the point where the passageway 102 communicates with the oil filter 103 is also above this oil level. As a result, even if the engine is stopped, these two ports will be above the oil level and siphoning action will be precluded so that lubricant cannot flow back into the engine 23.

Figure 8:
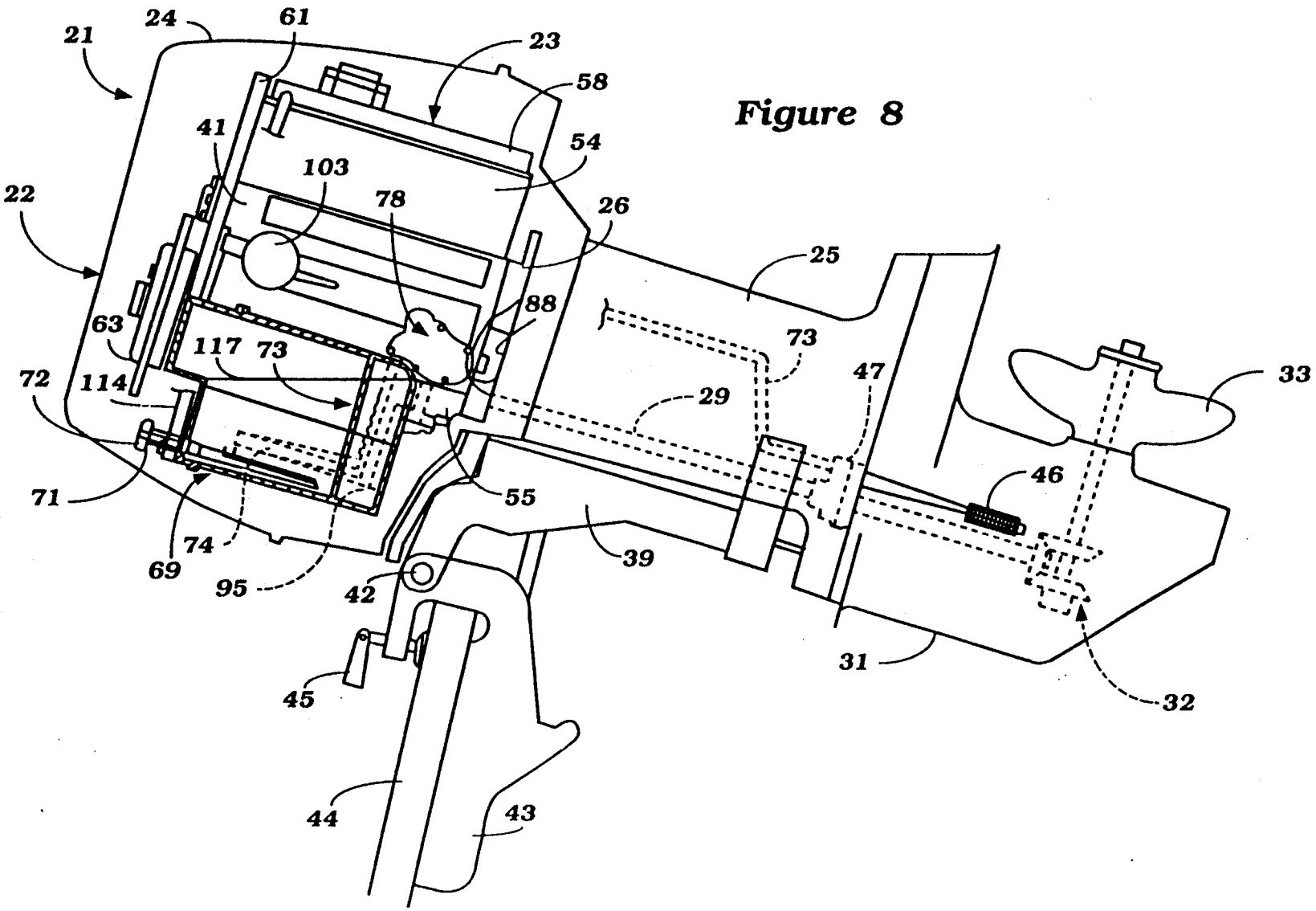
FIG. 8 is a side elevational view, in part similar to FIG. 1, and shows the outboard motor tilted up to its out of the water position.

Furthermore, the construction is such that when the outboard motor is tilted up to its out of the water position as shown in FIG. 8, the outlet port of the pressure pump 94 where it communicates with the oil filter 103 will be above the oil level as shown by the line 117 in this figure. In a like manner, the inlet port of the scavenge pump 93 will be above this oil level line 117 and siphoning action will be precluded.

In addition to these features, if the outboard motor 21 is removed from the watercraft, and laid on one side on the ground line G as shown in FIG. 9, the vent port 114 will have its inlet and outlet openings above the oil level 116 and also the return port 76 of the scavenge pump will be above this oil level. Furthermore, in this condition, the outlet port of the pressure pump where it meets the oil filter 103 will be above this line and no siphoning action of oil back into the engine can occur.

If the outboard motor is removed from the watercraft and placed on its backside along the ground line G as shown in the phantom line in FIG. 1, the oil level will assume the line 118 and both the inlet port 96 of the pressure pump and the outlet port 76 of the scavenge pump will be above oil line, then no siphoning action can occur.

With the aforedescribed construction, good lubrication can be achieved under all trim running operations. When the engine is stopped and even if the outboard motor is tilted up or laid on its side or back, lubricant cannot flow back into the engine through any siphoning action. Therefore, the aforenoted deleterious effects are clearly avoided with this construction It has been previously noted that this embodiment is provided with a water cooling system that includes the coolant pump 47 (FIG. 1). This coolant pump delivers water through a pressure conduit 119 to the engine 23 for its cooling. This cooling system includes a cylinder block cooling jacket which appears partially around an exhaust port 120 in FIG. 7 and which is identified by the reference numeral 121 and which also communicates with a cylinder head cooling jacket 122 as shown in FIG. 4 through means including an inlet conduit 123 formed in a side plate 124 of the engine 23.

Figure 10:
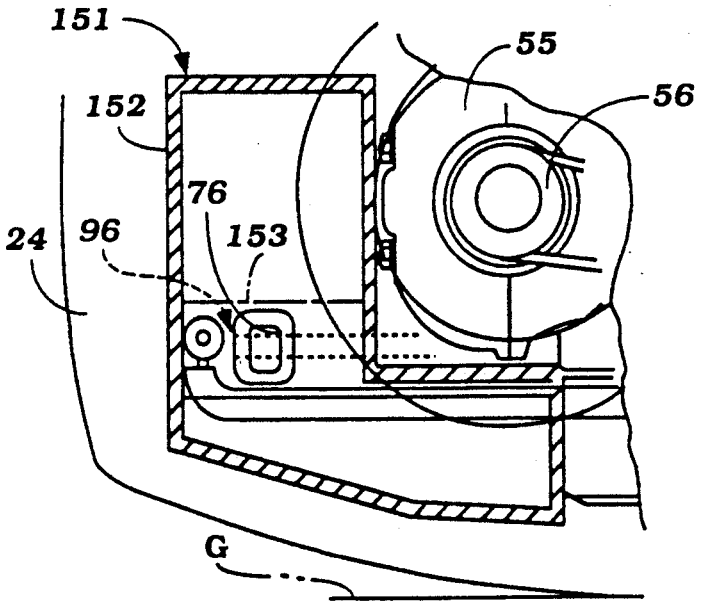
FIG. 10 is a top plan view, in part similar to FIG. 9, showing another embodiment of the invention.
Figure 11:
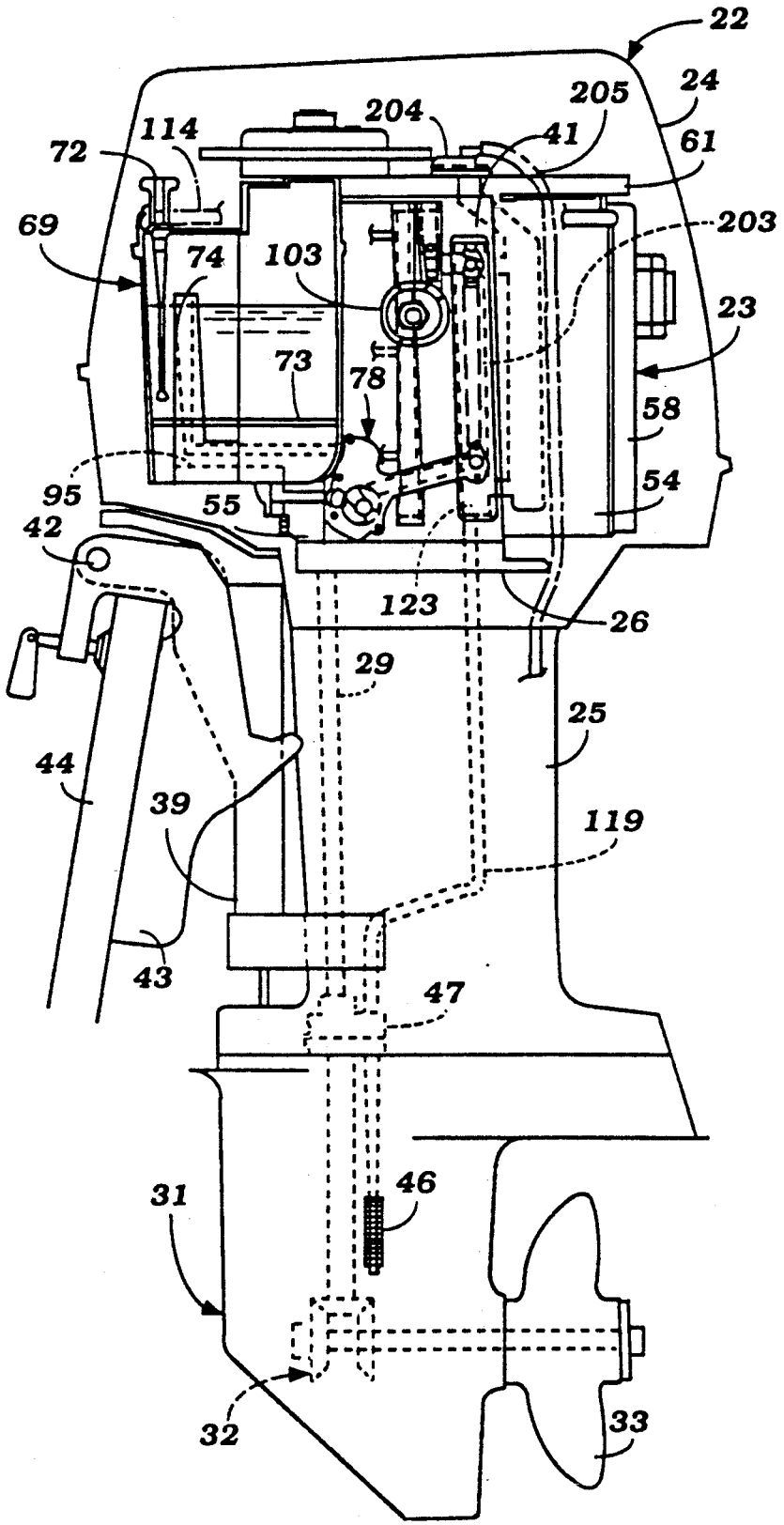
FIG. 11 is a side elevational view, with portions broken away and other portions shown in phantom, of an outboard motor constructed in accordance with another embodiment of the invention.
Figure 12:
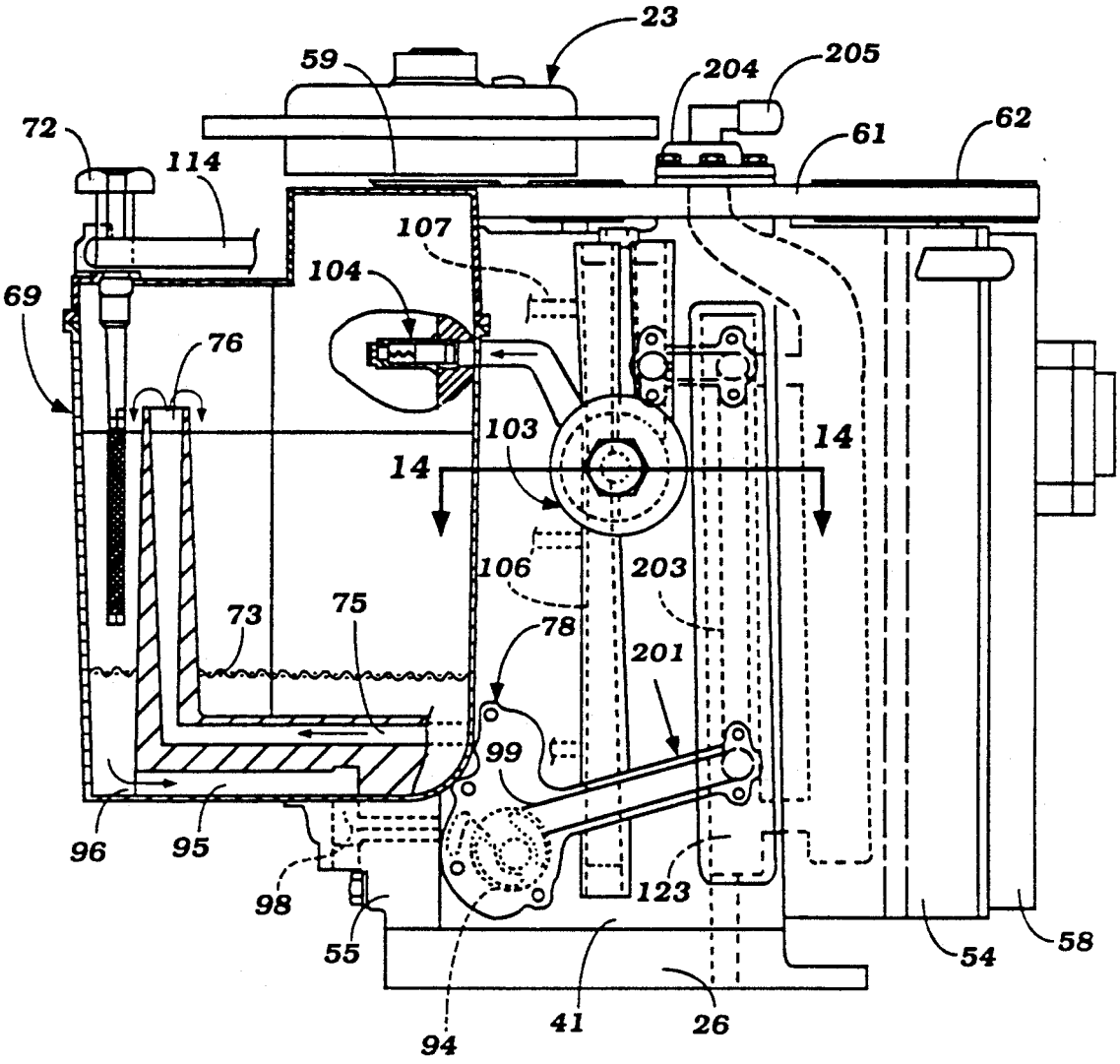
FIG. 12 is an enlarged side elevational view of the outboard motor and specifically at the engine and dry sump tank, with portions broken away.
Figure 13:
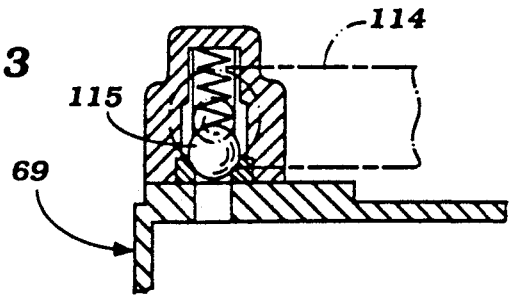
FIG. 13 is an enlarged cross sectional view showing where the crankcase ventilation system returns to the dry sump tank.
Figure 14:
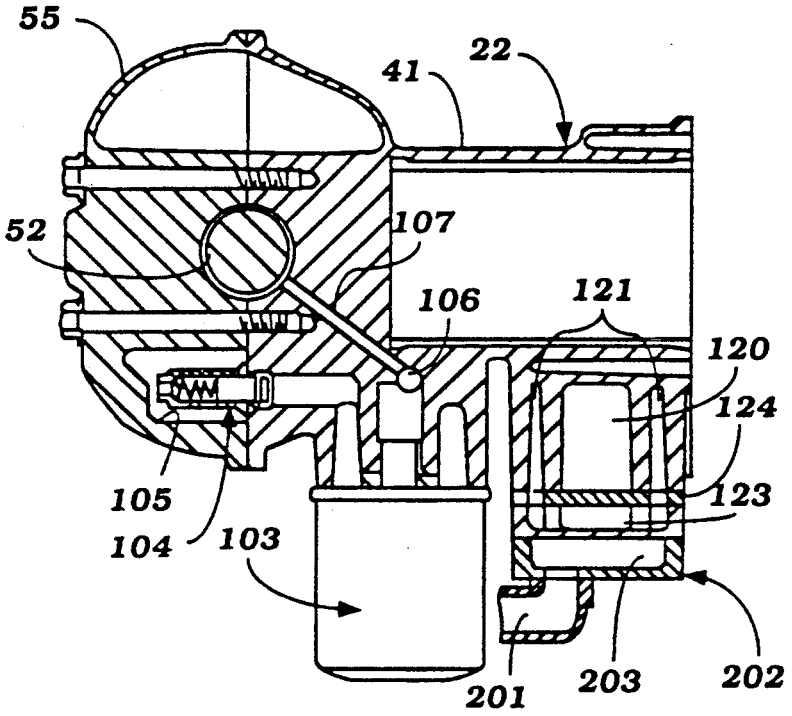
FIG. 14 is a cross sectional view taken along the line 14—14 of FIG. 12.

In the embodiment of the invention as thus far described, the scavenge and pressure pumps of the lubricating system always had one of their ports above the lubricant level regardless of whether the engine was laying on one side, its back, or tilted up. FIG. 10 shows another embodiment of the invention which is generally the same as the embodiment of FIGS. 1 through 9. For that reason, only a single figure is necessary to depict this embodiment. In this embodiment, however, the lubricant tank, indicated generally by the reference numeral 151 has an enlarged L shaped configuration formed by an extending portion 152 that runs along one end of the engine. This provides a substantial portion of volume which can be occupied by the lubricant if the outboard motor 21 is inverted from the position shown in FIG. 10. In this instance, the lubricant will flow to the line 153 and both the outlet port 76 of the scavenge pump and the inlet port 96 of the pressure pump will be above the lubricant level regardless of on which side the outboard motor is laid. As a result, this embodiment provides even further protection against anti-drain back of lubricant into the engine during such times as the engine is not running and is placed in storage orientation.

FIGS. 11 through 14 show another embodiment of the invention which may be generally the same as the embodiment of FIGS. 1 through 9 or the embodiment of FIG. 10. However, this embodiment has the further advantage of employing an arrangement for cooling the lubricant before it is delivered to the engine through cooperation with the engine cooling system. Because of these similarities, components which are the same as those of the embodiments previously described have been identified by the same reference numerals and will be described again only insofar as is necessary to understand the construction and operation of this embodiment.

In this embodiment, the pressure pump outlet 99 is formed in part in an external conduit 201 which extends to a cover assembly 202 that overlies the cover plate 124 and defines a vertically extending passageway 203 through which the oil may pass in heat exchanging relationship with the extended cooling jacket 123 that communicates the cylinder block cooling jacket and the cylinder head cooling jacket with the water inlet conduit 119 as aforedescribed. This passageway 203 then communicates with the oil filter 103 in the manner as previously described.

As may be seen, there is provided a thermostat housing 204 through which coolant may return to the body of water in which the watercraft is operating through a return conduit 205. As has been previously noted, this embodiment has the advantages of the aforedescribed embodiments insofar as preventing oil drain back from the lubricant system to the engine during such times as the engine is not running and regardless of its orientation.

Figure 15:
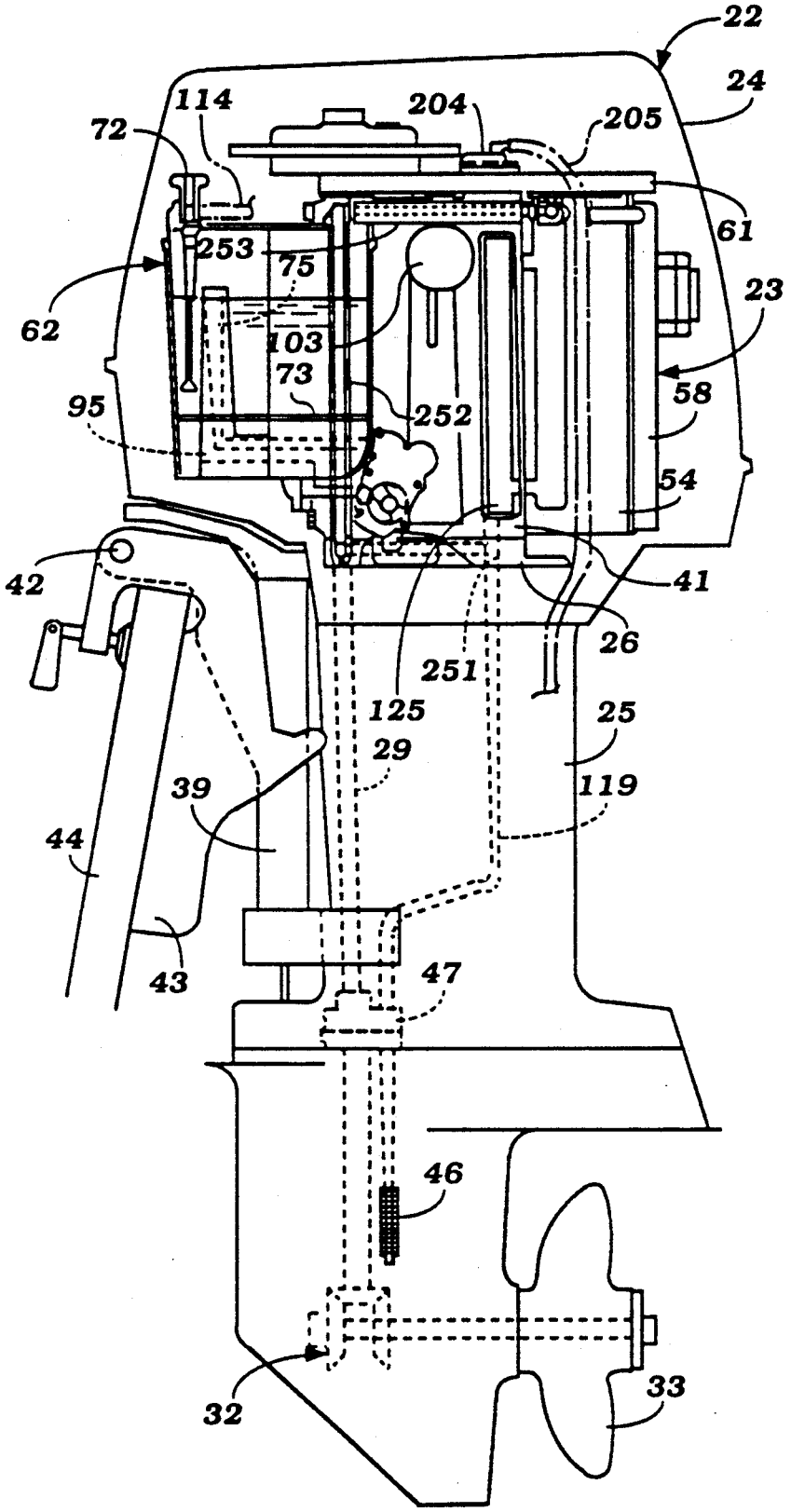
FIG. 15 is a side elevational view of an outboard motor as attached to the transom of a watercraft constructed in accordance with another embodiment of the invention, with portions broken away and other portions shown in section.

FIG. 15 shows another embodiment of the invention which is generally similar to the embodiment of FIGS. 11 through 14. Because of this, components of this embodiment which are the same as that of the embodiment of FIGS. 11 through 14 have been identified by the same reference numerals and will be described again only insofar as is necessary to understand the construction and operation of this embodiment.

In this embodiment, the conduit 119 which supplies water to the cylinder block and cylinder head cooling jackets already described, has a flow portion 251 that extends across through the spacer plate 26 to intersect a vertically extending heat exchanger 252 that passes through the lubricant reservoir 69. As a result, the lubricant in the lubricant reservoir can be cooled. This water is then returned to the cooling system through a return conduit 253. In all other regards, the embodiment is the same as those previously described.

Figure 16:
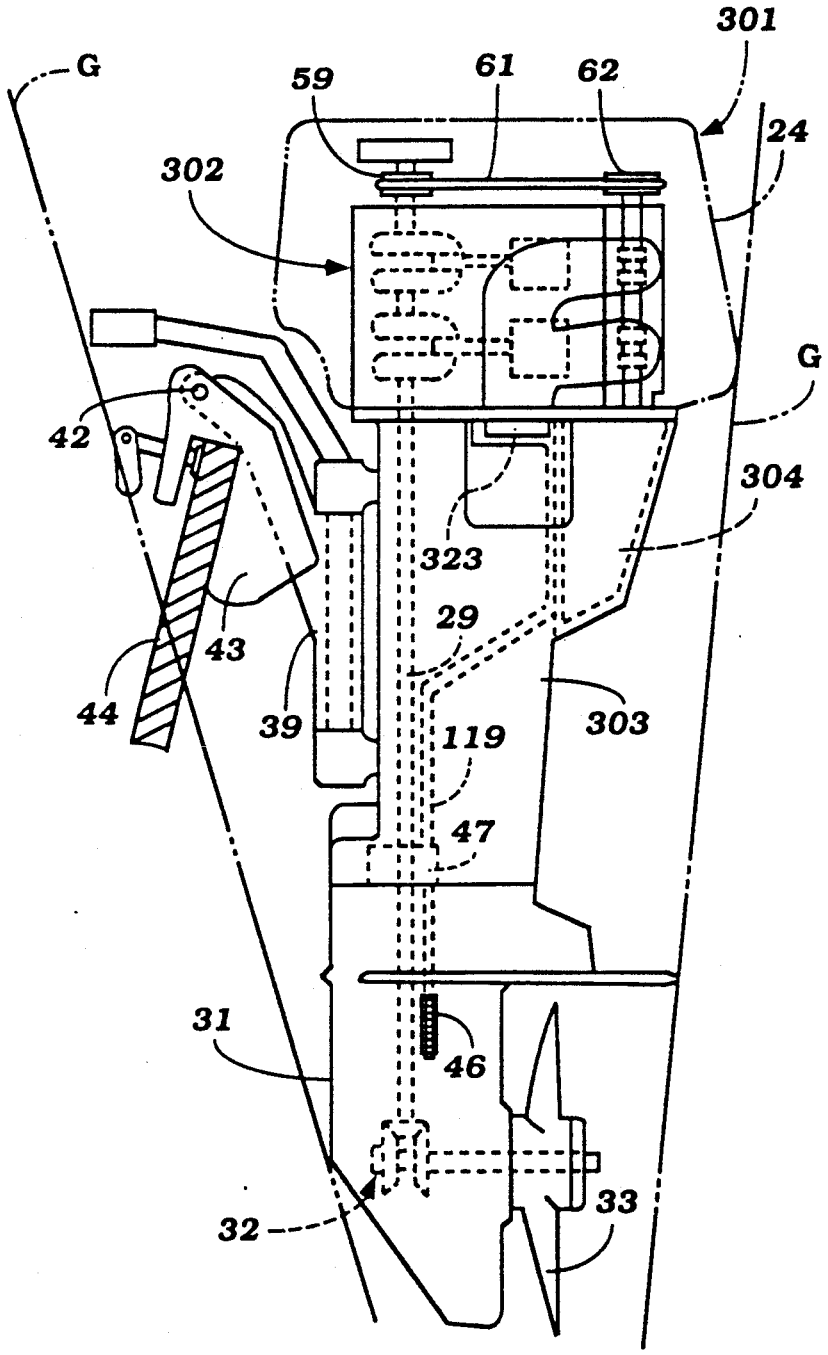
FIG. 16 is a side elevational view of an outboard motor constructed in accordance with another embodiment of the invention, as attached to the transom of an associated watercraft.
Figure 17:
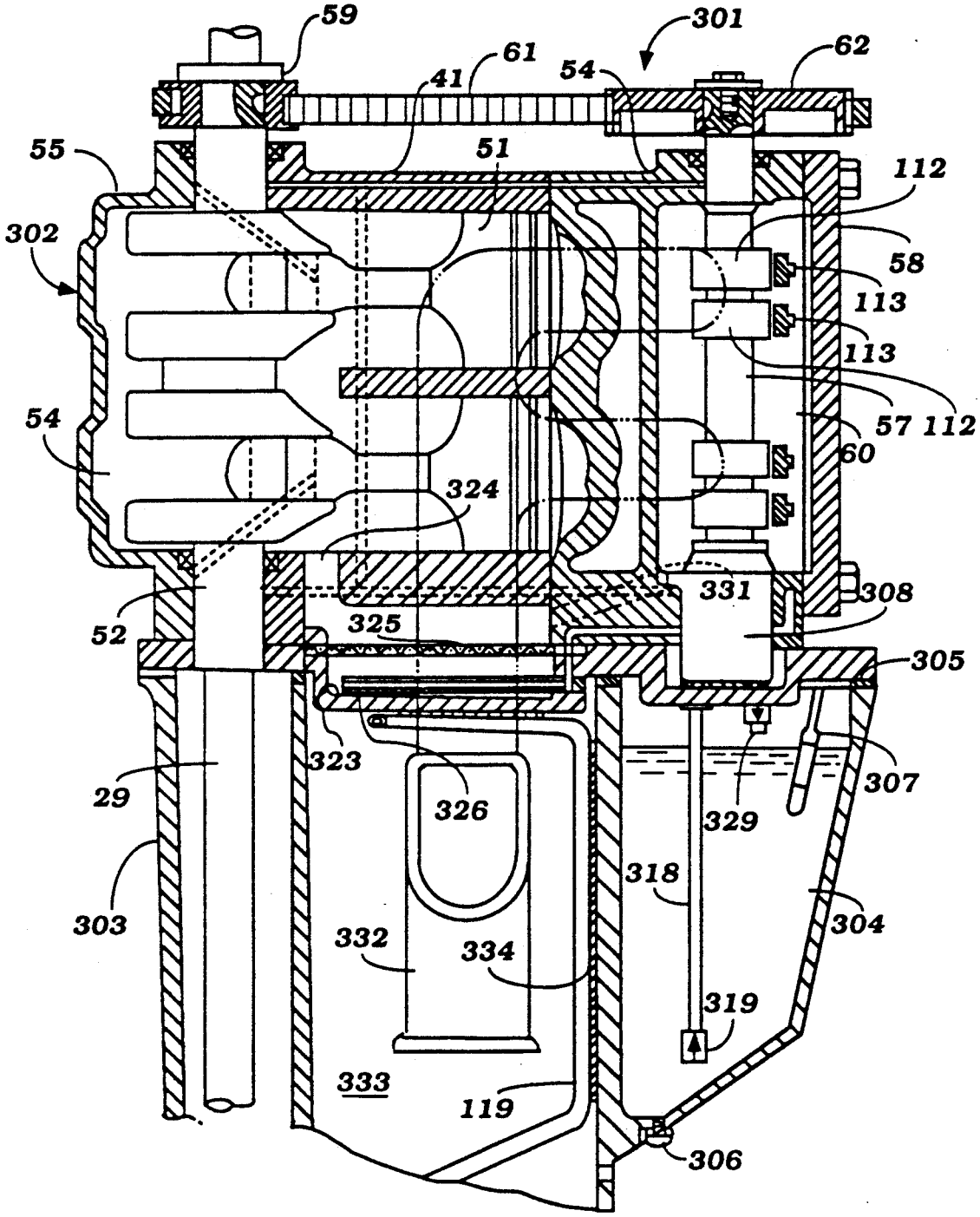
FIG. 17 is an enlarged cross sectional view taken through the engine and upper portion of the drive shaft housing of this embodiment.
Figure 18:
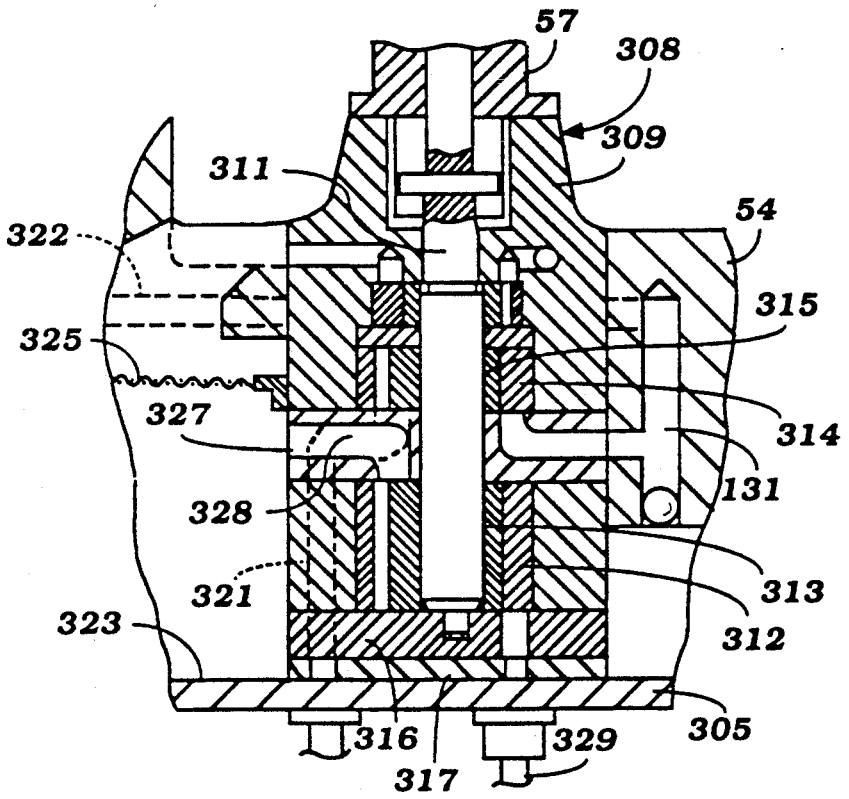
FIG. 18 is a cross sectional view taken through the lower end of the camshaft and showing how the lubrication system pumps are driven from the camshaft.

In the embodiments of the invention as thus far described, the lubricant reservoir has been positioned in the power head of the outboard motor. This construction has the advantage of permitting a large expansion chamber to be employed in the drive shaft housing of the outboard motor for silencing exhaust gases. However, this construction does have the disadvantage in that the lubricant reservoir is positioned remotely from the components of the engine which are lubricated and requires circuitry that is relatively long. FIGS. 16 through 18 show another embodiment of the invention wherein a slightly different lubricating arrangement is incorporated. Since the basic engine construction, except as will hereinafter be noted, is the same as the previously described embodiments, those components which are the same have been identified by the same reference numerals and will be described again only insofar as is necessary to understand the construction and operation of this embodiment.

In this embodiment, the outboard motor is identified generally by the reference numeral 301 and includes an internal combustion engine, indicated generally by the reference numeral 302 that has a construction basically similar to the basic construction of the engine of the embodiments as thus far described. In this embodiment, the drive shaft housing is identified by the reference numeral 303 and is provided with an integral dry sump oil reservoir 304 that is formed at its upper rear end and which is closed by means of a spacer plate 305 that extends between the engine 302 and the drive shaft housing 303. A drain plug 306 is provided in the drive shaft housing 303 so as to drain lubricant from the dry sump reservoir 304 for servicing. In addition, a dipstick 307 is provided for enabling the operator to check the amount of lubricant in the dry sump tank 304.

In this embodiment, a dry sump pump assembly 308 is positioned in a recess formed in the plate 305 and is driven from the camshaft 57 in a manner as may be best understood by reference to FIG. 18. As may be seen in this figure, the pump assembly 308 includes a housing 309 which is nested in part in a recess formed in the cylinder head 54. A pump drive shaft 311 has a suitable connection to the camshaft 57 so as to drive the pump 311.

The pump assembly 309 includes a scavenge pump 312 which is of the tricodal type and which has a rotor 313 driven by the pump shaft 311. In addition, there is provided a pressure pump 314 which is also of the tricodal type and which has a rotor 315 that is driven by the shaft 311. The pump housing 309 has an end plate 316 that is supported on the spacer plate 305 by means of an elastic bushing and gasket 317.

The pressure pump 314 draws lubricant from the dry sump tank 304 through an inlet conduit 318 that has a light check valve 319 at its lower or inlet end which serves to prevent flow into the conduit 318 when the engine is not running. This lubricant then flows through an internal passageway 321 of the pump housing 309 and is pressurized in the pressure pump 314 and delivered to the engine through a main supply conduit 322. The remaining circuitry for the delivery of oil from the pressure pump 314 to the engine 302 may be of the type previously described including an oil filter, delivery passages in the engine and the like and suitable cooling arrangements of any of the types as aforedescribed, if desired.

Lubricant which has collected in the crankcase chamber 54 is returned to a well, indicated generally by the reference numeral 323 that is formed in the crankcase 54, cylinder block 41 and spacer plate 305. A return passageway 324 is formed in the cylinder block 41 for this return flow from the crankcase chamber. A screen 325 is positioned across the well 323 for insuring that the large foreign particles and air will be removed from the system.

Lubricant is drained from the well 323 by the scavenge pump 312 through an elongated conduit 326 that is pressed into an opening 327 formed in the pump housing 309. This forms an inlet port 328 for the scavenge pump 312 and the lubricant thus collected is returned to the dry sump tank 304 through a short return conduit 329 which terminates above the normal oil level in the reservoir 304 when filled with a maximum amount of normal fluid. A light check valve is positioned in the conduit 329 to prevent reverse flow when the engine is not running and the engine is tilted so that the conduit 329 is submerged. A cam chamber drain passage 331 is formed also in the cylinder head 54 and extends into the well 323 for returning lubricant to the well that has lubricated the camshaft mechanism as aforenoted.

As will be readily apparent from the figures, at least one of the inlet and outlet ports of both the scavenge pump 312 and pressure pump 314 is always disposed above the oil level in the sump 304 regardless of whether the engine is in its normal position or lying down either on its front side or rear side as shown by the ground line G in FIG. 16. As a result, this embodiment also has the advantages of the previously described embodiments in that lubricant cannot be drained back to the engine during such times as engine is not running. Also, because of the close proximity of the oil tank 304 to the pressure pump 314, it will be insured that lubricant will be delivered to the engine immediately upon restarting.

This embodiment also shows an exhaust manifold 332 that extends from the exhaust ports of the engine and which terminates in an expansion chamber 333 formed in the drive shaft housing. A heat transmitting material 334 is positioned between the coolant pipes 119 and the dry sump tank 304 for cooling purposes.

Figure 19:
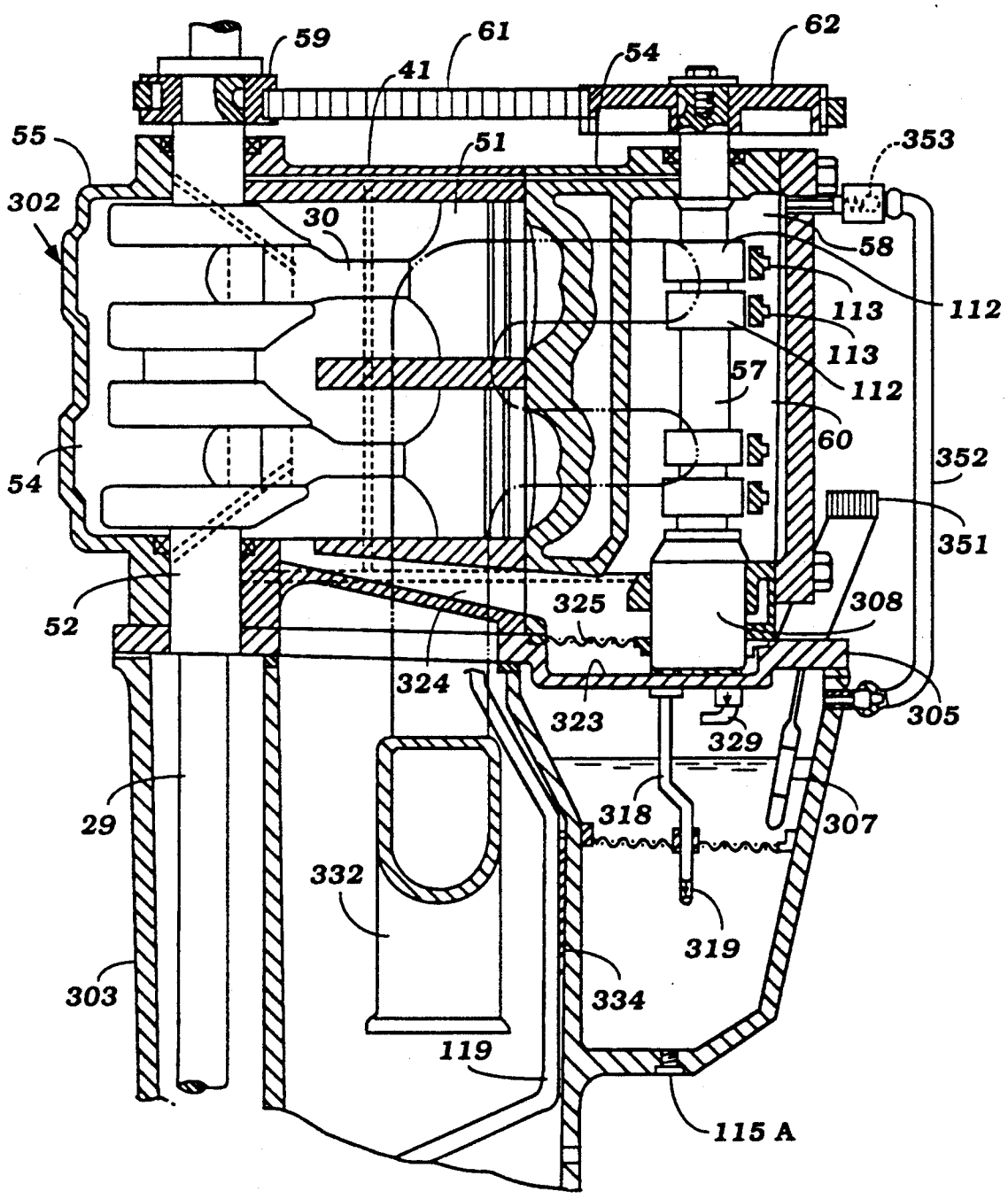
FIG. 19 is a cross sectional view, in part similar to FIG. 17, showing yet another embodiment of the invention.

FIG. 19 shows another embodiment of the invention which is generally the same as the embodiment of FIGS. 16 through 18. In this embodiment, however, the well 323 is formed around the pump assembly 308. Hence the pick up tube for delivery to the scavenge pump portion can be eliminated. Also, this embodiment shows the fill pipe 351 for the dry sump tank 304 and also a vent passageway 352 between the cam chamber 60 and the upper level of the dry sump tank in which a check valve 353 is provided so as to preclude reverse flow of lubricant. Such venting and fill arrangements can be utilized in conjunction with the embodiments of FIGS. 16 through 18. Since, in all other regards, this embodiment is the same as the one described in FIGS.

16 through 18, further description of it is believed to be unnecessary.

It should be readily apparent from the foregoing description that a number of embodiments of the invention have been illustrated and described, each of which provides a very effective dry sump lubrication system while insuring that lubricant cannot drain back to the engine when the engine is not running. Also, the embodiments disclose arrangements for insuring that lubricant cannot run back to the engine even if it is tilted up out of the water or is removed from the watercraft and laid on either its sides, front or rear surface. Although a number of embodiments of the invention have been illustrated and described, various other changes and modifications may be made without departing from the spirit and scope of the invention, as defined by the appended claims.

What is claimed is:

1. An outboard motor comprised of a power head having a powering internal combustion engine have an internal lubrication system, a propulsion unit driven by said engine for propelling an associated watercraft, means for mounting said outboard motor upon a hull of the associated watercraft for movement between a plurality of trim adjusted positions and a tilted up out of the water position, a dry sump lubricant reservoir for containing lubricant for lubricating said engine, a scavenge pump driven by said engine and having an inlet port communicating with the engine internal lubricating system for receiving lubricant therefrom and an outlet port for returning lubricant to said dry sump lubricant reservoir, and a pressure pump having an inlet port for drawing lubricant from said dry sump lubricant reservoir and an outlet port for delivering lubricant under pressure to the engine internal lubricating system, at least one port of each of said pumps being positioned above the normal lubricant level within said dry sump lubricant reservoir in all positions of said outboard motor for precluding the draining of lubricant from said dry sump lubricant reservoir back to the engine when the engine is not running.

2. An outboard motor as set forth in claim 1 wherein the outboard motor is detachable from the associated watercraft and at least one port of each of the pumps is disposed above the oil level in the dry sump oil reservoir when the detached outboard motor is laid on its side and at least one of its front or rear edges.

3. An outboard motor as set forth in claim 2 wherein at least one of the ports of each of pumps is disposed above the level of lubricant in the dry sump lubricant reservoir regardless of how the outboard motor is laid on the ground when detached from the associated watercraft.

4. An outboard motor as set forth in claim 1 wherein the dry sump lubricant reservoir is contained within the power head and externally of the engine.

5. An outboard motor as set forth in claim 4 wherein the engine has its output shaft rotating about a vertically extending axis and wherein the normal level of lubricant in the dry sump oil reservoir when the outboard motor is operating in its normal trim adjusted positions lies above the lower end of the engine output shaft.

6. An outboard motor as set forth in claim 5 wherein the outboard motor is detachable from the associated watercraft and at least one port of each of the pumps is disposed above the oil level in the dry sump oil reservoir when the detached outboard motor is laid on its side and at least one of its front or rear edges.

7. An outboard motor as set forth in claim 6 wherein at least one of the ports of each of pumps is disposed above the level of lubricant in the dry sump lubricant reservoir regardless of how the outboard motor is laid on the ground when detached from the associated watercraft.

8. An outboard motor as set forth in claim 1 further including check valve means in the discharge side of each of the pumps for precluding flow back to the pump from its outlet port in the event the pump is not operating.

9. An outboard motor as set forth in claim 1 wherein the dry sump lubricant reservoir is positioned within the drive shaft housing of the outboard motor.

10. An outboard motor as set forth in claim 9 wherein the internal combustion engine has a vertically extending shaft driven by the engine that is disposed above the dry sump lubricant reservoir and which drives the pumps.

11. An outboard motor as set forth in claim 10 wherein the shaft that drives the lubricant pumps comprises the camshaft of the engine.

12. An outboard motor as set forth in claim 11 wherein the outboard motor is detachable from the associated watercraft and at least one port of each of the pumps is disposed above the oil level in the dry sump oil reservoir when the detached outboard motor is laid on its side and at least one of its front or rear edges.

13. An outboard motor as set forth in claim 12 wherein at least one of the ports of each of pumps is disposed above the level of lubricant in the dry sump lubricant reservoir regardless of how the outboard motor is laid on the ground when detached from the associated watercraft.

14. An outboard motor as set forth in claim 9 wherein the outboard motor is detachable from the associated watercraft and at least one port of each of the pumps is disposed above the oil level in the dry sump oil reservoir when the detached outboard motor is laid on its side and at least one of its front or rear edges.

15. An outboard motor as set forth in claim 14 wherein at least one of the ports of each of pumps is disposed above the level of lubricant in the dry sump lubricant reservoir regardless of how the outboard motor is laid on the ground when detached from the associated watercraft.

16. An outboard motor comprised of a power head having a powering internal combustion engine having an internal lubrication system, a propulsion unit driven by said engine for propelling an associated watercraft, means for mounting said outboard motor upon a hull of the associated watercraft for movement between a plurality of trim adjusted positions and a tilted up out of the water position, a dry sump lubricant reservoir for containing lubricant for lubricating said engine, a scavenge pump driven by said engine and having an inlet port communicating with the engine internal lubricating system for receiving lubricant therefrom and an outlet port for returning lubricant to said dry sump lubricant reservoir, a pressure pump having an inlet port for drawing lubricant from said dry lubricant reservoir and an outlet port for delivering lubricant under pressure to the engine internal lubricating system, each of said pumps having check valve means in its discharge side for precluding flow back to the pump from which its output port when the engine is not running.

17. An outboard motor as set forth in claim 16 wherein the dry sump lubricant reservoir is contained within the power head and externally of the engine.

18. An outboard motor as set forth in claim 17 wherein the engine has its output shaft rotating about a vertically extending axis and wherein the normal level of lubricant in the dry sump oil reservoir when the outboard motor is operating in its normal trim adjusted positions lies above the lower end of the engine output shaft.

19. An outboard motor as set forth in claim 16 wherein the dry sump lubricant reservoir is positioned within the drive shaft housing of the outboard motor.

20. An outboard motor as set forth in claim 19 wherein the internal combustion engine has a vertically extending shaft driven by the engine that is disposed above the dry sump lubricant reservoir and which drives the pumps.

21. An outboard motor as set forth in claim 20 wherein the shaft that drives the lubricant pumps comprises the camshaft of the engine.

* * * * *